US005988024A

United States Patent [19]

Boyd et al.

[11] Patent Number: 5,988,024

[45] **Date of Patent: *Nov. 23, 1999**

[54] ADJUSTABLE BOX WRENCH

[76] Inventors: Bill E. Boyd, 358 Brightview Dr., Lake Mary, Fla. 32746; William D. Boyd, 1654 Torrington Cir., Longwood, Fla. 32750

[ * ] Notice: This patent issued on a continued prosecution application filed under 37 CFR 1.53(d), and is subject to the twenty year patent term provisions of 35 U.S.C. 154(a)(2).

[21] Appl. No.: 08/785,655

[22] Filed: Jan. 17, 1997

[51] Int. Cl.[6] ..... B25B 13/16

[52] U.S. Cl. ..... 81/170; 81/166

[58] Field of Search ..... 81/166, 170

[56] References Cited

U.S. PATENT DOCUMENTS

| | | | |
|---|---|---|---|
| D. 239,759 | 5/1976 | Glantz | D8/22 |
| D. 303,916 | 10/1989 | Colvin | D8/22 |
| D. 304,669 | 11/1989 | Boyd et al. | D8/22 |
| D. 313,925 | 1/1991 | Cone | D8/22 |
| D. 322,545 | 12/1991 | Cone | D8/22 |
| 390,422 | 10/1888 | White . | |
| 717,390 | 12/1902 | Gray . | |
| 1,133,132 | 3/1915 | Greb | 81/170 |
| 1,359,403 | 11/1920 | Lynds | 81/166 |
| 3,204,497 | 9/1965 | Dinkler | 81/77 |
| 4,520,699 | 6/1985 | Jeremic | 81/166 |
| 4,766,786 | 8/1988 | Jeremic | 81/129 |
| 4,967,613 | 11/1990 | Cone | 81/166 |
| 4,987,805 | 1/1991 | Ejdenwik | 81/77 |

FOREIGN PATENT DOCUMENTS

| | | |
|---|---|---|
| 60657 | 3/1923 | Sweden . |

*Primary Examiner*—James G. Smith
*Attorney, Agent, or Firm*—Rader, Fishman & Grauer PLLC

[57] ABSTRACT

An improved adjustable box wrench having a mouth (9) with a plurality of gripping surfaces (27, 31, 32) for surrounding a nut, bolt or the like. A movable jaw (5) allows the size of the mouth to be altered when a worm screw (8) is turned. The worm screw (8) has gear (24) which fit between teeth (20) in an arm (4) extending from the movable jaw (5). The adjustment arm (4) and worm screw (8) fit into cavities (14, 17) in the wrench body (1). Increased lateral support for the movable jaw is provided by protrusions (19) on each side (21) of the jaw which fit into and move longitudinally within channels (26) in fixed gripping surfaces (32) on opposite sides of the mouth (9). A removable closure plate (6) covers the adjustment arm (4) and the worm screw (8) and facilitates assembly of the wrench and disassembly for repair or other purposes.

10 Claims, 2 Drawing Sheets

ADJUSTABLE BOX WRENCH

BACKGROUND OF THE INVENTION

This invention relates to tools and more particularly, to an improved wrench which is adjustable to fit completely around any size of nut, bolt or the like.

Conventional adjustable wrenches utilize a pair of jaws which contact only two sides of a nut or a bolt, thereby making the wrench prone to slipping during use. Such wrenches also allow too much play due to the adjustment mechanisms used therein. Slippage during use can cause injury to the user's knuckles or other part of the hands. In an effort to overcome such problems, adjustable wrenches which grip nuts and bolts on all sides, also known as "box wrenches," have been developed. However, current box wrenches often still allow too much play, thereby losing their grip or lock on a nut or bolt during use.

Thus, there exists a need for an improved adjustable box wrench that eliminates play and provides a non-slip grip or lock on bolts and nuts which are not provided by current box wrenches.

The most pertinent prior art includes the following patents:

| Patent No. (U.S. unless stated otherwise) | Inventor | Issue Date |
|---|---|---|
| 390,422 | White | Oct. 2, 1888 |
| 4,766,786 | Jeremic | Aug. 30 1988 |
| Des.239,759 | Glantz | May 4, 1976 |
| 4,987,805 | Ejdenwik | Jan. 29, 1991 |
| Swed.60657 | | March 11, 1923 |
| Des.313,925 | Cone | Jan. 22, 1991 |
| Des.322,545 | Cone | Dec. 24, 1991 |
| 3,204,497 | Dinkler | Sept. 7, 1965 |
| 717,390 | Gray | Dec. 30, 1902 |
| Des.303,916 | Colvin | Oct. 10, 1989 |
| Des.304,669 | Boyd et al. | Nov. 21, 1989 |
| 4,967,613 | Cone | Nov. 6, 1990 |

The White patent teaches an adjustable box wrench with a gripping jaw which uses a thumb nut on a screw rod as the adjustment mechanism. The Jeremic patent discloses an adjustable wrench with a removable key adjustment mechanism. The Glantz patent shows an adjustable ring spanner for a wrench. The Ejdenwik patent discloses an adjustable wrench with a box end different from the present invention. The Swedish patent shows a wrench with an adjustable box end. The two Cone design patents show adjustable box wrenches with gripping ends. The Dinkler patent teaches a double ended adjustable box wrench. The Gray patent discloses a double-ended adjustable wrench. The Colvin patent shows another double ended adjustable box wrench with a different gripping head than the present invention. The Cone utility patent teaches an adjustable box wrench that requires a large aperture in the jaw slot into which the thumb wheel screw and the threaded adjustment rod must fit. Thus, as designed the adjustment mechanism of the Cone patent allows considerable play in the adjustment mechanism, making it susceptible to slippage during use.

Although the prior art contains many patented box wrenches, none has the same structure as the present invention which provides the benefits of the present invention as is described and illustrated herein.

SUMMARY OF THE INVENTION

The major objects of the present invention are to provide an improved adjustable box wrench which:

Provides a better grip on nuts, bolts and the like by eliminating play in the grip;

Is more precise;

Provides more lateral support, thereby even further reducing slippage;

Is stronger than conventional box wrenches;

Is safer than other adjustable box wrenches because it reduces slippage and thereby reduces the likelihood of injury; and Provides a "lock" on a nut or bolt, thereby reducing the likelihood of slippage.

The present invention fulfills the above and other objects by providing an improved adjustable box wrench having a handle and jaw portion. The jaw portion has a plurality of gripping surfaces which form a closed mouth for placing around bolts, nuts and the like. Two of the gripping surfaces are longitudinally located on opposite sides of the mouth and are fixed. A third gripping surface is fixed and is located at the distal end of the mouth and a fourth gripping surface resides on a movable jaw which is adjustable according to the size of the nut, bolt or the like on which the wrench is used. An adjustment arm is connected to the movable jaw on an opposite side of its gripping surface. The adjustment arm moves longitudinally within a cavity located in the wrench between the mouth and the handle. Means for moving the adjustment arm is also provided in the cavity adjacent to the arm in the wrench. An elongated handle is provided which extends longitudinally from the jaw portion to provide sufficient leverage for turning nuts, bolts and the like. To facilitate assembly and disassembly of the wrench for repair or other purposes, a removable closure plate is provided which covers the adjustment arm and adjustment means. The fixed gripping surface on the distal end and the movable gripping surface on the movable jaw at the proximal end of the mouth, may each have two equal length angular surfaces indented outward from the center of the mouth to provide more lateral support to the gripping surfaces for use on nuts and bolts having more than four sides. For increased strength and to reduce slippage the mouth may contain grooves in the two longitudinal gripping surfaces and the movable jaw may have outward protrusions on its sides which fit into and move within the grooves whenever the size of the mouth is adjusted. The adjustment means use to move the adjustment arm, thereby changing the size of the mouth, is preferably a worm screw with helical gears on its circumference which fit into teeth on the adjustment arm, such that when a worm screw is turned it causes the adjustment arm to move longitudinally within the longitudinal cavity, thereby moving the movable jaw and altering the size of the mouth as desired.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENT

Figure 1:
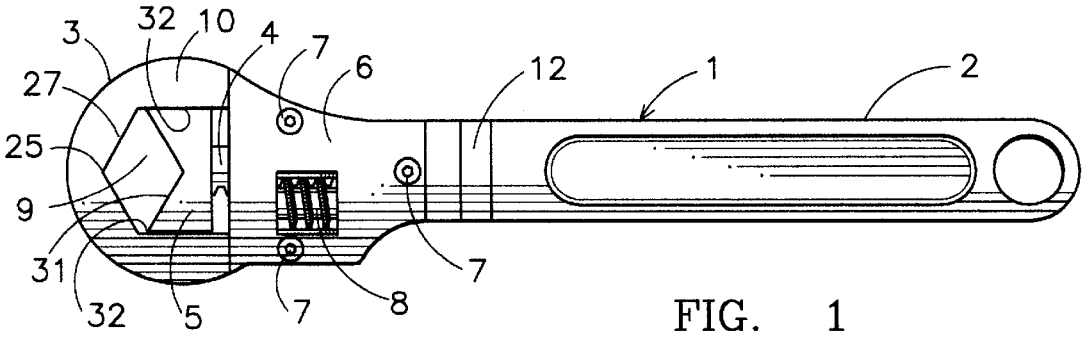
FIG. 1 is a top view of the improved adjustable box wrench of this invention in an assembled configuration.

For purposes of describing the preferred embodiment, the terminology used in reference to the numbered components in the drawings is as follows:

| | |
|---|---|
| 1. wrench body | 21. sides of jaw |
| 2. handle | 22. movable indent of adjustable jaw |
| 3. head | 23. pointed tips of adjustable jaw. |
| 4. adjustment arm | 24. worm screw turning gear |
| 5. movable jaw | 25. distal fixed gripping surface |
| 6. closure plate | 26. channel for side extensions |
| 7. securing screws for closure plate | 27. fixed distal slanted gripping surface face |
| 8. adjustment worm screw | 28. screw holes in closure plate |
| 9. mouth (cavity) | 29. closure plate cavity |
| 10. top of head | 30. worm screw pin front tip holding cavity |
| 11. bottom of head | 31. slanted gripping surface |
| 12. top slant | 32. fixed longitudinal gripping surfaces |
| 13. bottom slant | 33. removal slot |
| 14. adjustment arm cavity | 34. central hole in worm screw (8) |
| 15. holes for plate securing screws (8) | |
| 16. holding pin for worm screw | |
| 17. worm screw cavity | |
| 18. slot for worm screw pin | |
| 19. side extensions | |
| 20. adjustment arm teeth | |

Referring to FIG. 1, the wrench body 1 contains an elongated handle 2 which extends longitudinally from the head of the wrench 3. The head of the wrench 3 contains a mouth or cavity 9 which is designed to fit around a nut, bolt or the like. The mouth 9 is adjustable in size by moving a movable jaw 5 between two longitudinal gripping surfaces 32 on opposite sides of the mouth 9. The slanted gripping surface 31 of the movable jaw, together with the two longitudinal gripping surfaces 32 and the fixed gripping surface 27 on the distal end of the mouth completed or enclosed the head of a nut or bolt or the like on which the wrench is being used.

As further illustrated in FIGS. 1, 2, 3 and 4, the movable jaw 5 is moved longitudinally by means of an adjustment arm 4 that is contained in a cavity 14 between the handle 2 and the head 3 of the wrench. The cavity 14 is large enough to accommodate the full movement of the arm 4 so that the movable jaw 5 can move within the entire length of the mouth 9 to fit a wide range of sizes of nuts, bolts and the like.

Figure 5:
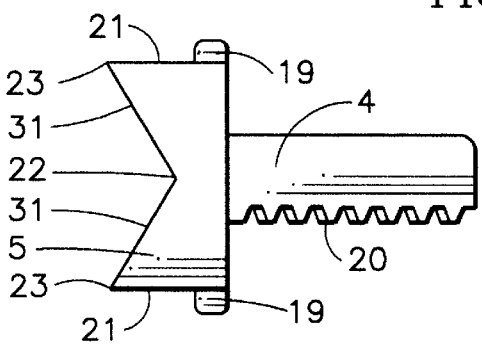
FIG. 5 is a top view of the movable jaw and adjustment arm.
Figure 6:
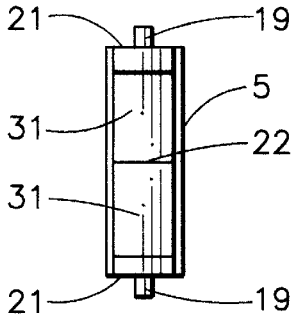
FIG. 6 is an end view of the movable jaw and adjustment arm.
Figure 7:
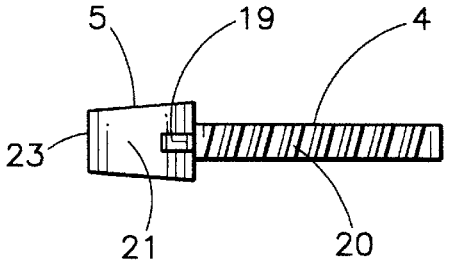
FIG. 7 is a bottom view of the movable jaw and adjustment arm.
Figure 8:
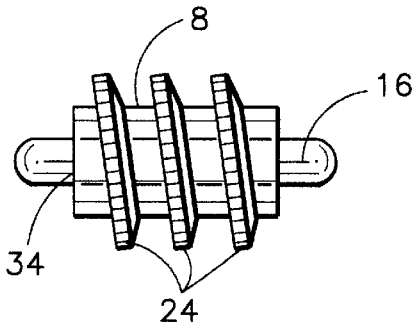
FIG. 8 is a side plan view of the adjustment worm screw with holding pin.

As shown in FIGS. 5, 6 and 7 the adjustment arm 4 contains angular teeth 20. The adjustment means consists of a worm screw 8 as shown in FIG. 8, which is mounted by a holding pin 18 in a cavity 17 adjacent and contiguous with the cavity 14 for the adjustment arm 4. The worm screw 8 contains angular turning gear 24 which fit between the teeth 20 and the adjustment arm 4 such that when the worm screw 8 is turned by a user's fingers the adjustment arm 4 in turn moves the movable jaw 5, thereby changing the size of the mouth 9. The combination of the worm screw 8 and adjustment arm 4 provides an adjustment means that is precise, accurate and reduces play in the movable jaw 5 when the mouth 9 is around a nut, bolt or the like.

Figure 9:
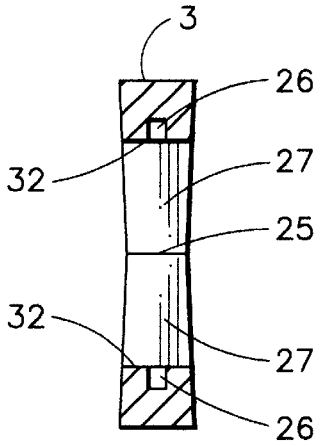
FIG. 9 is an end cross-sectional view of the mouth of the wrench along lines A—A of FIG. 3.

To provide further lateral support for the movable jaw 5, as shown in FIG. 9, a longitudinal channel 26 is provided in the longitudinal surfaces 32 on the opposite sides of the mouth 9 into which a protrusion 19 located adjacent a lowermost end on each side of the jaws 21 is inserted and moves within as the size of the mouth 9 is adjusted. The proximal gripping surfaces of the movable jaw 5 and the opposing distal gripping surface 27 would be comprised of equal length angular surfaces 31 on the movable jaw 5 and on the distal gripping surface 27. These gripping surfaces would be slanted outward from the center of the mouth to meet at vortices 22 on the movable jaw 5 and 25 on the distal fixed gripping surface, respectively. In this manner the mouth 9 of the wrench could be used on a variety of nuts and bolts ranging from those having four sides or more.

Figure 2:
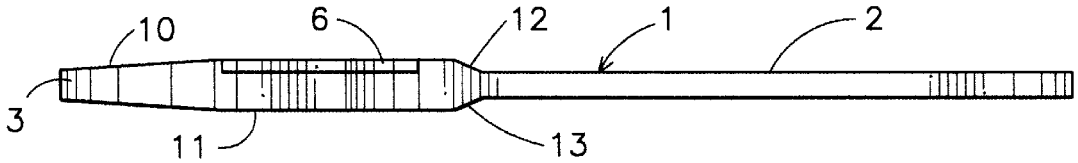
FIG. 2 is a side view of the improved adjustable box wrench of this invention in an assembled configuration.
Figure 3:
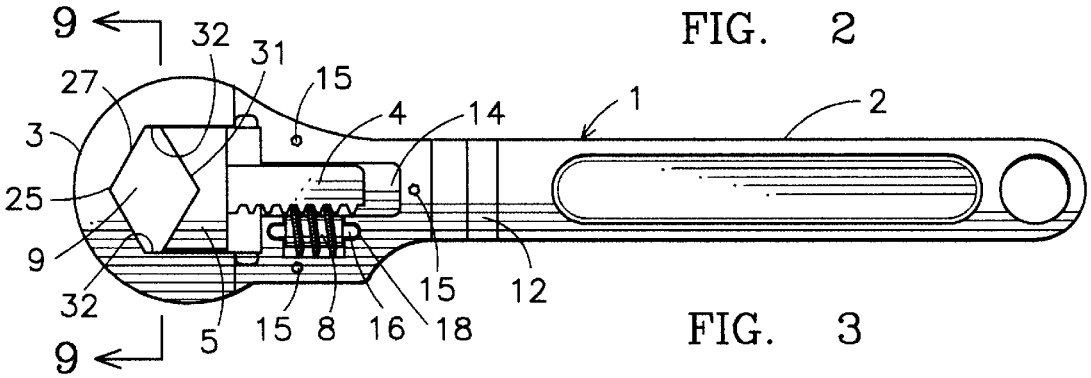
FIG. 3 is a top view the improved adjustable box wrench of this invention with the closure plate removed.
Figure 4:
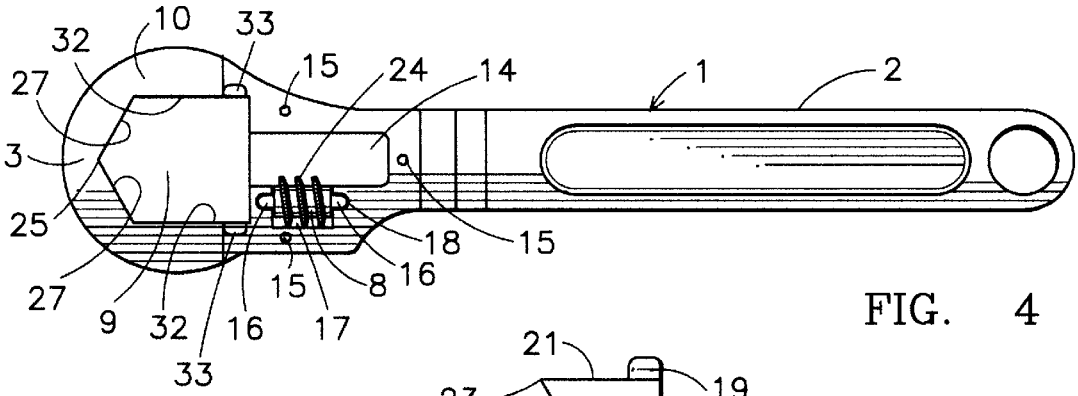
FIG. 4 is a top view of the wrench body with both the closure plate and the movable jaw adjustment arm removed.

As shown in FIGS. 1, 2 and 3, to facilitate assembly of the wrench and disassembly for repair or other purposes, the wrench may have a removable closure plate 6 covering the cavity with adjustment arm 14 and cavity for the adjustment worm screw 8 to secure the adjustment arm 4 and worm screw 8 in place. Preferably the closure plate 6 would have removable securing screws 7 which would fit into holes 15 in the wrench body 1. The wrench body under the removable closure plate 6 would also have slots 33 at the proximal end of the mouth so that the movable jaw 5 and adjustment arm 4 could be removed by allowing the protrusions 19 on the sides of the jaw 21 to be lifted. The movable jaw 5 could also contain sides 21 with pointed ends 23 which fully contact the longitudinal gripping surfaces 32 to provide further lateral support and strength for the wrench.

Figure 10:
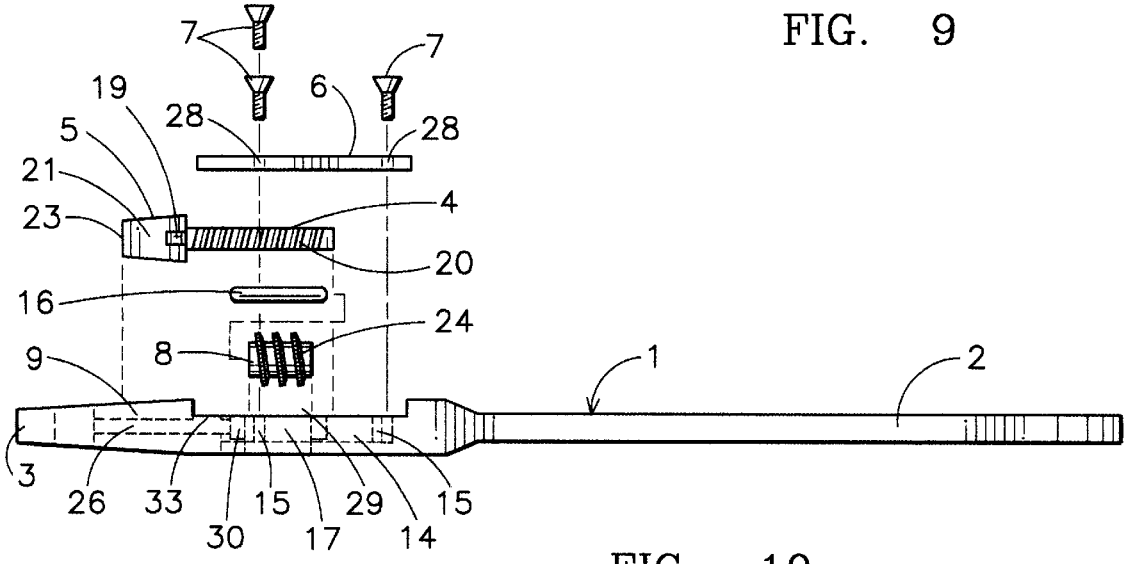
FIG. 10 is a side exploded plan view of the improved adjustable box wrench of this invention.

In FIG. 10 all of the components of the wrench and the manner of assembly are illustrated. First, with the wrench body 1 having a head 3 and handle 2 as previously described, the holding pin 18 is inserted into the central hole 34 in the worm screw 8 which in turn is placed into the cavity 17 in the wrench body with the front of the pin 18 being placed into a worm screw pin front tip holding cavity 30. Then the adjustment arm 4 and removable jaw 5 are placed into the adjustment arm cavity 14 and mouth 9 so that the gear 24 on the worm screw 8 fit between the slanted teeth 20 on the adjustment arm 4 and the protrusion 19 on the sides 21 of the movable jaw 5 fit into slots 33. The final step in the assembly process is to install the closure plate 6 by inserting screws 7 through holes 28 and into threaded holes 15 in the body of the wrench 1. In addition, head 3 includes a top and a bottom that taper toward each other beginning at the removable closure plate 6. See also FIG. 2.

It should become readily apparent that as described and illustrated above in relation to the preferred embodiment, this invention provides a new and improved adjustable box wrench with improved adjustment means that reduces play in the adjustable jaw 5 and which reduces slippage of the mouth 9 while used around a nut or bolt. Increased lateral support is provided by protrusions 19 which fit into groves 26 in the opposing longitudinal gripping surfaces 32. Easy assembly and disassembly is provided by use of a closure plate 6.

Although only a few embodiments of the present invention have been described in detail hereinabove, all improvements and modifications to this invention within the scope or equivalents of the claims are covered by this invention.

Having thus described my invention, we claim:

1. An adjustable box wrench comprising:

an elongated handle;

a head connected to one end of said elongated handle;

an aperture provided in said head and having a distal end and a proximal end;

a movable jaw including a first gripping surface and sides, said movable jaw being positioned in said aperture for sliding movement between said proximal end and said distal end for allowing said wrench to selectively grip a workpiece;

a protrusion provided on each of said sides of said movable jaw;

an adjustment arm connected to said movable jaw on an opposite side of said first gripping surface;

a gear for cooperating engagement with said adjustment arm for selectively moving said movable jaw;

a second gripping surface provided at a distal end of said aperture in opposing relationship to said first gripping surface;

third and fourth gripping surfaces extending longitudinally between said first and second gripping surfaces, said third gripping surface being in opposing, spaced apart relation to said fourth gripping surface;

a support groove provided in each of said third and said fourth gripping surfaces for mating engagement with a respective said protrusion on said movable jaw to increase lateral support of said movable jaw; and a removal slot located along each of said support grooves for permitting removal of said protrusions from said support grooves to disassemble and repair said wrench.

2. The adjustable wrench of claim 1, wherein said gear includes a worm screw.

3. The adjustable wrench of claim 1, wherein said head includes a top and a bottom that taper inwardly toward each other.

4. The adjustable wrench of claim 1, wherein said protrusions are located adjacent a lowermost end of said sides.

5. The adjustable wrench of claim 1, further comprising a cavity in said wrench for receiving said adjustment arm and a removable closure plate to cover said cavity.

6. The adjustable wrench of claim 1, wherein said adjustment arm includes teeth on only one side of said adjustment arm.

7. The adjustable wrench of claim 1, wherein said removal slots are located adjacent said proximal end of said cavity.

8. The adjustable wrench of claim 1, wherein said movable jaw and said protrusions are unitary.

9. The adjustable wrench of claim 5, wherein said head includes a top and a bottom that taper inwardly toward each other beginning at said removable closure plate.

10. An adjustable box wrench comprising:

an elongated handle;

a head connected to one end of said elongated handle;

an aperture provided in said head and having a distal end and a proximal end;

a movable jaw including a first gripping surface and sides, said movable jaw being positioned in said aperture for sliding movement between said proximal end and said distal end for allowing said wrench to selectively grip a workpiece;

a protrusion provided on each of said sides of said movable jaw, said protrusions being located adjacent a lowermost end of said sides;

an adjustment arm connected to said movable jaw on an opposite side of said first gripping surface;

a gear for cooperating engagement with said adjustment arm for selectively moving said movable jaw;

a second gripping surface provided at a distal end of said aperture in opposing relationship to said first gripping surface;

third and fourth gripping surfaces extending longitudinally between said first and second gripping surfaces, said third gripping surface being in opposing, spaced apart relation to said fourth gripping surface;

a support groove provided in each of said third and said fourth gripping surfaces for mating engagement with a respective said protrusion on said movable jaw to increase lateral support of said movable jaw; and a removal slot located along each of said support grooves for permitting removal of said protrusions from said support grooves to disassemble and repair said wrench, said removal slots being located adjacent said proximal end of said cavity;

said head including a top and a bottom that taper inwardly toward each other; and wherein said wrench further includes a cavity for receiving said adjustment arm and a removable closure plate to cover said cavity.

* * * * *